US005452662A

United States Patent [19]

Switzeny

[11] Patent Number: 5,452,662

[45] Date of Patent: Sep. 26, 1995

[54] DEVICE FOR COUPLING A GONDOLA OR A CHAIR TO THE OVERHEAD CABLE OF A CABLEWAY SYSTEM

[75] Inventor: Kurt Switzeny, Hard, Austria

[73] Assignee: Konrad Doppelmayr & Sohn Maschinenfabrik Gesellschaft m.b.H. & Co. KG, Wolfurt, Germany

[21] Appl. No.: 218,524

[22] Filed: Mar. 28, 1994

[30] Foreign Application Priority Data

Mar. 30, 1993 [AT] Austria ..... 640/93

[51] Int. Cl.[6] ..... B61B 12/12

[52] U.S. Cl. ..... 104/206; 104/209; 104/215; 104/216

[58] Field of Search ..... 104/204, 205, 104/206, 209, 211, 214, 215, 216, 218, 220

[56] References Cited

U.S. PATENT DOCUMENTS

| | | | |
|---|---|---|---|
| 805,464 | 11/1905 | Hewitt | 104/205 |
| 1,218,372 | 3/1917 | Carstarphen . | |
| 2,955,544 | 10/1960 | Goirand | 104/206 |
| 4,686,906 | 8/1987 | Meindl | 104/204 |
| 4,760,798 | 8/1988 | Blengini | 104/211 |
| 5,111,751 | 5/1992 | Zlotek | 104/209 |

FOREIGN PATENT DOCUMENTS

| | | |
|---|---|---|
| 370686 | 4/1983 | Austria . |
| 388346 | 6/1989 | Austria . |
| 464945 | 5/1927 | Germany . |
| 5345566 | 12/1993 | Japan . |

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A device for coupling a ferry, such as a gondola or chair, to the hoisting or load cable of an overhead cableway system includes a clamping body with rollers. A first clamping jaw is rigidly secured. A second clamping jaw can be swiveled relative to the first clamping jaw. The second clamping jaw is located on one end of a two-armed clamping lever on whose other end a control element, such as a cam roller, is provided. When the control elements cooperates with an actuator, such as a cam rail, the clamping lever is pivoted relative to the clamping body counter to the action of at least one torsion spring. That pivoting causes the second clamping jaw to reach its open position. A toggle joint or elbow joint is provided which connects the torsion spring with the clamping lever.

9 Claims, 7 Drawing Sheets

DEVICE FOR COUPLING A GONDOLA OR A CHAIR TO THE OVERHEAD CABLE OF A CABLEWAY SYSTEM

BACKGROUND OF THE INVENTION

1. Field of the Invention:

The invention relates to a device for coupling a ferrying means, such as a gondola or chair, to the hoisting or load cable of a cableway system, comprising a clamping body provided with rollers that has a rigidly secured first clamping jaw and a second clamping jaw that can be swiveled relative to the first clamping jaw. The second clamping jaw is disposed on one end of a two-armed clamping lever on whose other end a control element, in particular a cam roller, is provided that cooperates with a cam rail, as a result of which the clamping lever is pivoted relative to the clamping body counter to the action of at least one torsion spring. That pivoting causes the second clamping jaw to reach its open position.

2. Description of the Related Art:

Swiss Patent No. 544 678 discloses a cable clamp which has a spring in the form of a torsion rod coupled to one of the clamping jaws via a toothed gearing. Known cable clamps of this kind that are embodied with torsion springs or helical compression springs are disadvantageous, however, because they do not completely meet the technical requirements.

This is because cable wear or stretching of the cable causes changes in the cable diameter, and it is then necessary for the movable clamping jaw to be pivoted towards the rigid clamping jaw. However, this reduces the clamping force substantially, and hence the requisite pulloff force of the clamp is no longer assured.

SUMMARY OF THE INVENTION

It is accordingly an object of the invention to provide a device for coupling a gondola or a chair to the overhead cable of a cableway system, which overcomes the hereinaforementioned disadvantages of the heretofore-known devices of this general type and which averts any substantial reduction in the clamping force upon the approach of the two clamping jaws toward one another.

With the foregoing and other objects, in view there is provided, in accordance with the invention, a device for coupling a ferrying means, i.e. the hanger of a gondola or a chair, to the hoisting or load cable of a cableway system, comprising:

- a clamping body having a first clamping jaw rigidly secured thereto;
- a two-armed clamping lever pivotally supported on the clamping body, the clamping lever carrying a second clamping jaw on one end thereof which is pivotable relative to the first clamping jaw between an open and a closed position of the coupling device;
- a torsion spring operatively associated with the clamping lever for biasing the clamping lever in the closed position of the coupling device; and
- a toggle joint disposed between and connecting the clamping lever and the torsion spring.

In other words, the invention solves the problems associated with the prior art device of this general kind, in that a toggle joint (elbow or knee lever joint) is provided between the clamping lever and the torsion spring. As a result it is assured that if the movable clamping jaw is swiveled in its closing direction, as a consequence of reductions in the cable diameter caused by wear or expansion, virtually the same clamping force is brought to bear regardless.

The structural embodiment of this device is preferably chosen such that the toggle joint can be moved into a beyond-dead-center position, such that the clamp remains open after being opened.

In a preferred embodiment, a first lever of the toggle joint is secured to the free end of the at least one torsion spring, and a second lever supported on the clamping lever is pivotably connected to the first lever. Preferably, the pivot point of the two levers of the toggle joint is located on the clamping lever between the pivot bearing and the bearing of the second lever of the toggle joint on the clamping lever; in the closed position of the two clamping jaws, the pivot point is located on the clamping lever between the torsion spring and an imaginary line connecting the pivot bearing with the bearing of the second lever of the toggle joint on the clamping lever. Conversely in the open position of the pivotable clamping jaw, the pivot point is located on the far side of that connecting line.

In a further preferred embodiment, the pivot point of the two levers of the toggle joint is located on the clamping lever approximately in the middle between the pivot bearing of the clamping lever and the bearing of the second lever of the toggle joint.

In another preferred embodiment, the torsion spring is embodied as a torsion rod protruding to both sides from the clamping body and on whose two free ends sleeves are secured. Two lever arms are secured on the sleeves which form the first lever of the toggle joint. The two sleeves can be rigidly joined each on one end to the free ends of the torsion rod, and their other ends, from which the first levers of the toggle joint protrude, are supported on a bush in the clamping body.

In an apparatus according to the invention, the clamping lever is moreover embodied with a clamping force testing device. As a result, the clamping force is constantly monitored and whenever it drops below a predetermined value, the operation of the cableway system is stopped, whereupon the corresponding clamping spring can be inspected, or it can be replaced by a fully functional clamping spring.

Other features which are considered as characteristic for the invention are set forth in the appended claims.

Although the invention is illustrated and described herein as embodied in a device for coupling a gondola or a chair to the overhead cable of a cableway system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
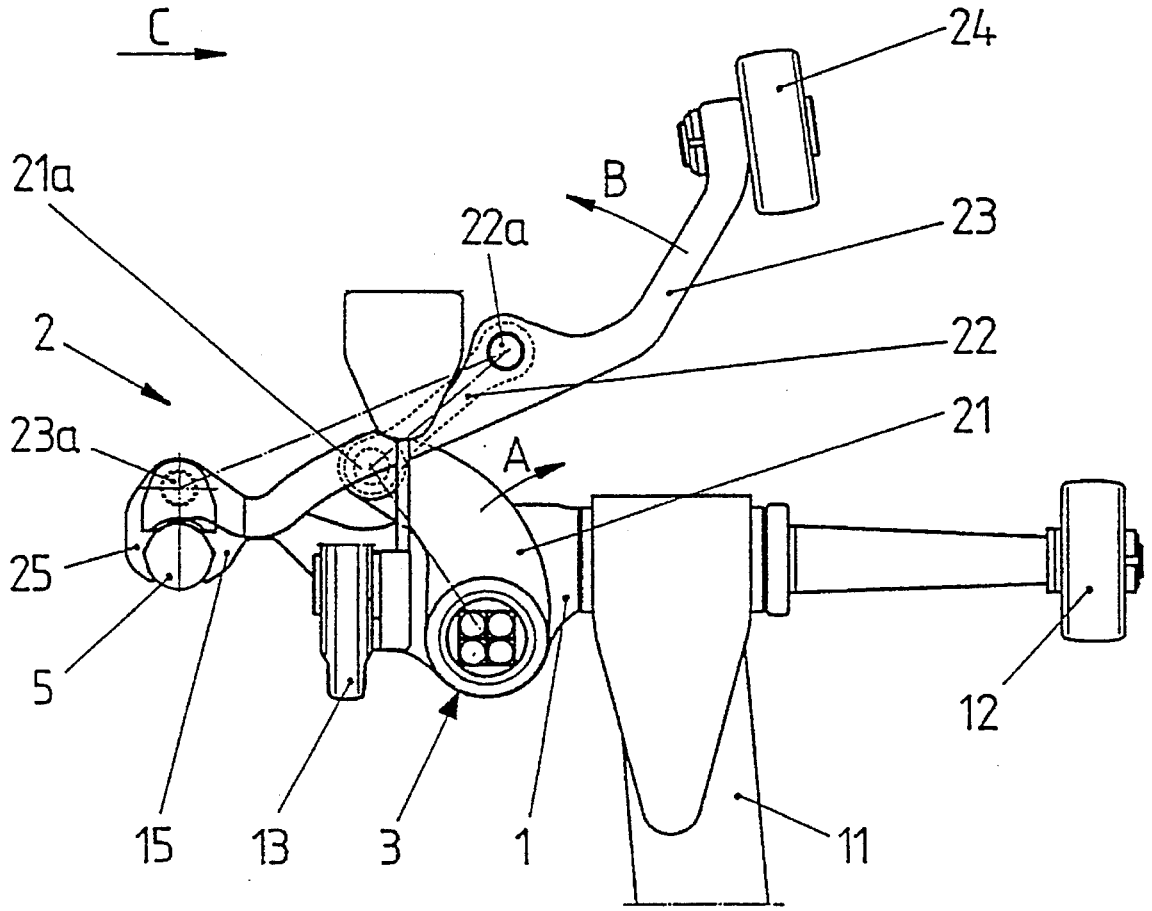
FIG. 1 is a side-elevational view of a first embodiment of a device according to the invention in a closed position of the two clamping jaws.
Figure 2:
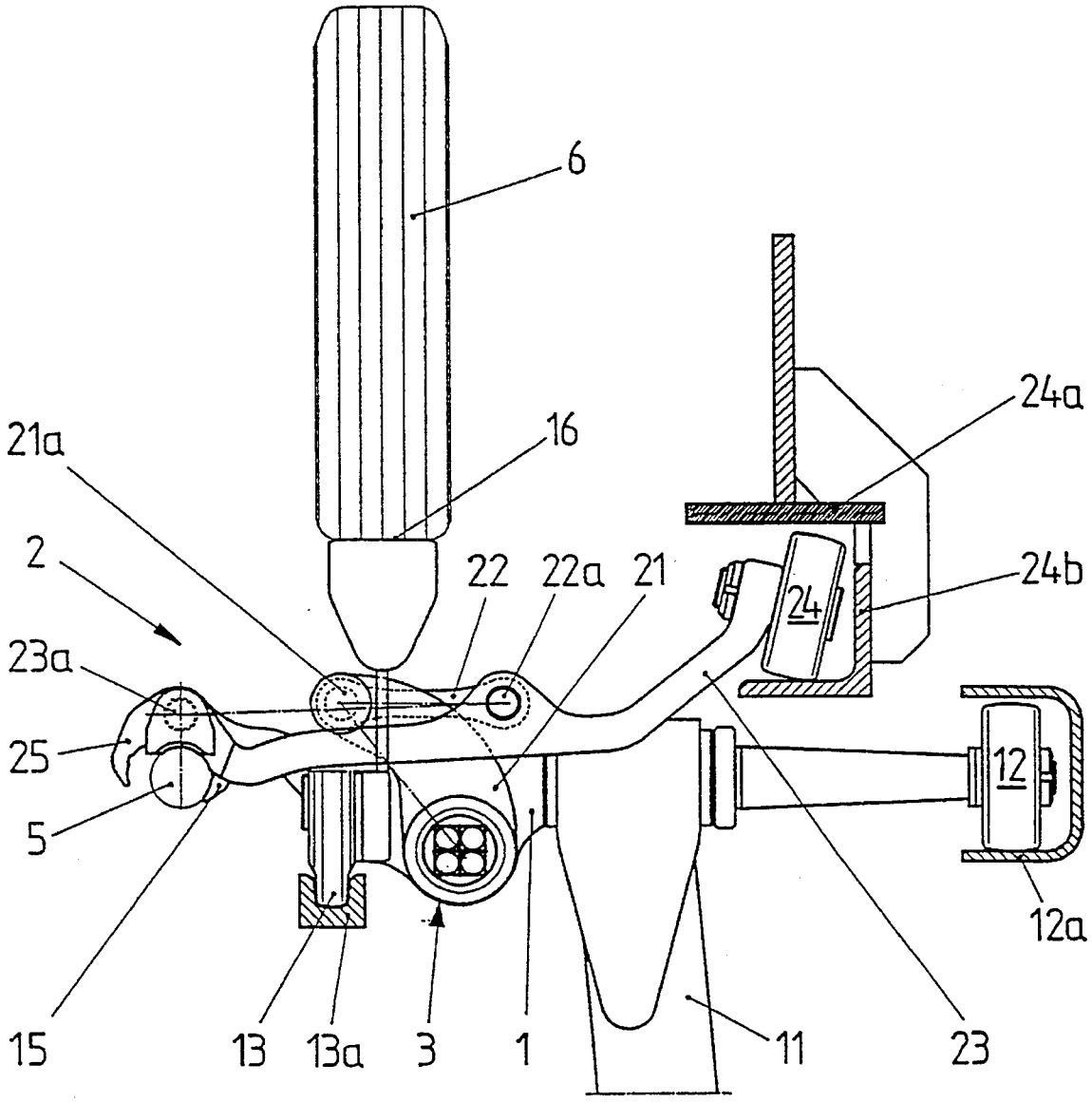
FIG. 2 is a similar view of the embodiment of FIG. 1 in an open position of the two clamping jaws.

Referring now to the figures of the drawing in detail and first, particularly, to FIGS. 1 and 2 thereof, there is seen a clamping body 1 to which a hanger or suspension bar 11 is secured which carries a gondola or a chair of an overhead cableway. Also supported on the clamping body 1 are rollers 12 and 13, by means of which the clamping body 1 is guided in the stations of the cableway system along rails 12*a* and 13*a*.

The clamping device 2 comprises a torsion spring 3, likewise secured to the clamping body 1, to which a first lever 21 is secured. A second lever 22 is pivotably connected to the free end of the first lever 21. The other end of the second lever 22 is supported on a clamping lever 23, which in turn is supported in a bearing 23*a* (second pivot bearing) on the stationary clamping jaw 15. The two levers 21 and 22 form a toggle joint that is operative between the torsion spring 3 and the clamping lever 23.

The end on the left in the drawing of the clamping lever 23 is embodied as a movable clamping jaw 25, which is put in the closed position of the clamp when the clamping lever 23 is pivoted in a counter-clockwise direction by means of the torsion spring 3. As a result, a cable 5 is encompassed by the two clamping jaws 15 and 25. The other end of the clamping lever 23 is provided with a cam roller 24. When the gondola or the chair enters a station of the cableway system, the cam roller 24 runs on cam rails 24*a*, and as a result the clamping lever 23 is pivoted in such a way that the clamping jaw 25 reaches the open position counter to the action of the torsion spring 3.

FIG. 1 shows the position of the clamping device in which the clamping jaw 25 is in its closed position, and as a result the clamping body 1 is coupled to the cable 5. The pivot point 21*a*, also referred to as toggle pivot means, of the two levers 21 and 22 of the toggle joint is located between the torsion spring 3 and an imaginary line that connects the bearing 23*a* of the clamping lever 23 on the rigid clamping jaw 15 with the pivot bearing 22*a* (first pivot bearing) of the second lever 22 on the clamping lever 23. The first lever 21 of the toggle joint is biased in the direction of an arrow A by the torsion spring 3. This causes the clamping lever 23 to be biased in the direction of the arrow B. As a result, the clamping jaw 25 enters the closed position and is held in it. The closing force required for this is brought to bear by the torsion spring 3.

When the gondola or chair, i.e. the clamping device, enters the station of the cableway system, whereupon the rollers 12 and 13 then roll along rails 12*a* and 13*a*, the cam roller 24 also rolls on a cam rail 24*a*, and as a result the clamping lever 23 is swiveled counter to the direction of the arrow B, counter to the action of the torsion spring 3. This moves the clamping jaw 25 into its open position. As a result of the swiveling of the clamping lever 23, the toggle joint 21 and 22 reaches a beyond-dead-center position, in which the connecting line between the bearings 22*a* and 23*a* is located between the torsion spring 3 and the pivot point 21*a*. As a result, the clamping jaw 25 is held in the open position by the torsion spring. The cam roller 24 runs along a cam rail 24*b* in that case.

FIG. 2 also shows one of the acceleration or deceleration wheels 6 located in the stations, which come to rest on a friction plate 16 also provided on the clamping body 1. As a result, in the stations, the speed of the ferrying means decoupled from the hoisting cable 5 is reduced, so that the passengers can leave or enter the ferrying means, or the speed of the ferrying means is increased enough that these means can be re-coupled to the cable 5.

Figure 3:
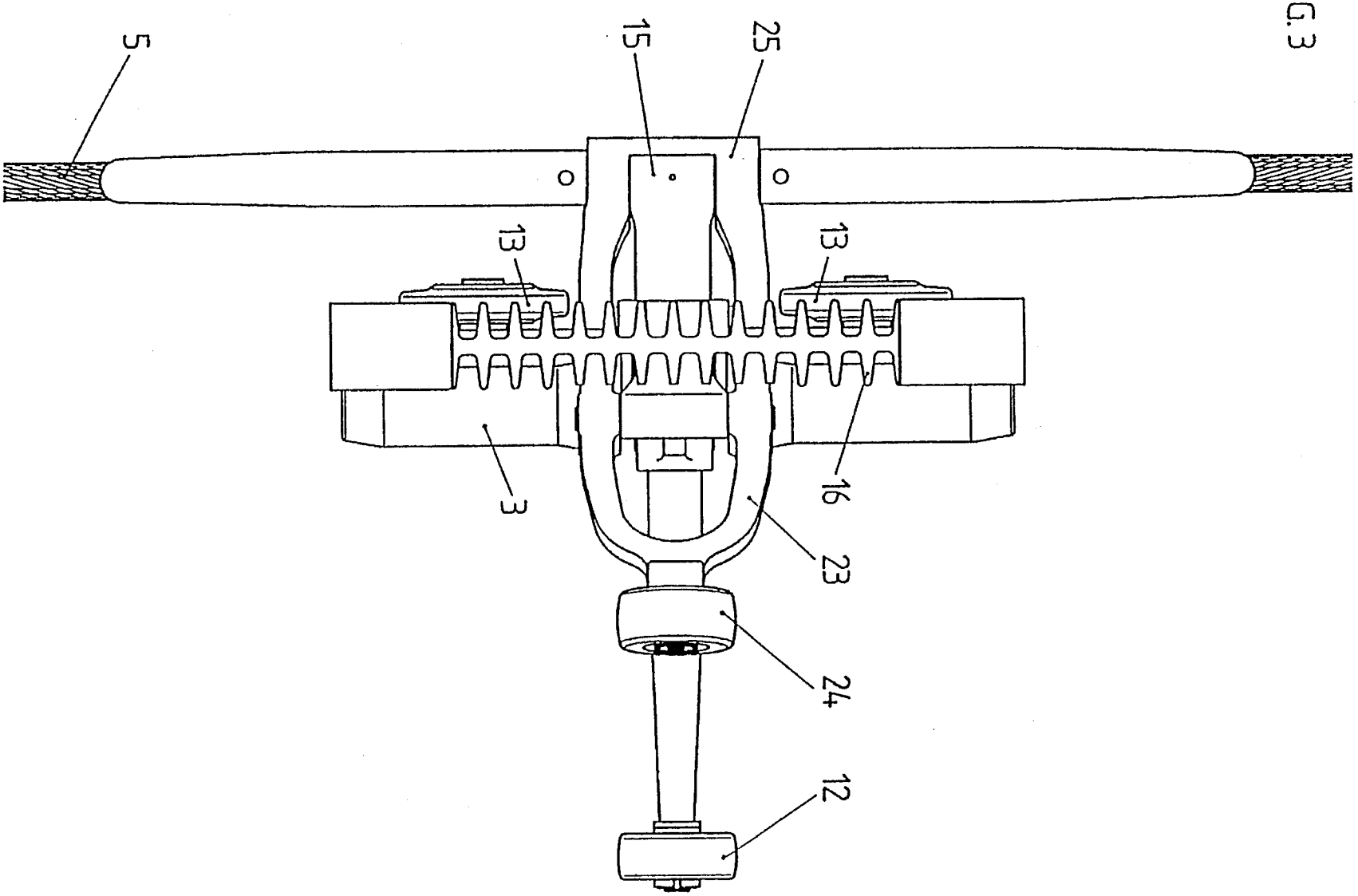
FIG. 3 is a top-plan view of the device according to FIG. 1.
Figure 4:
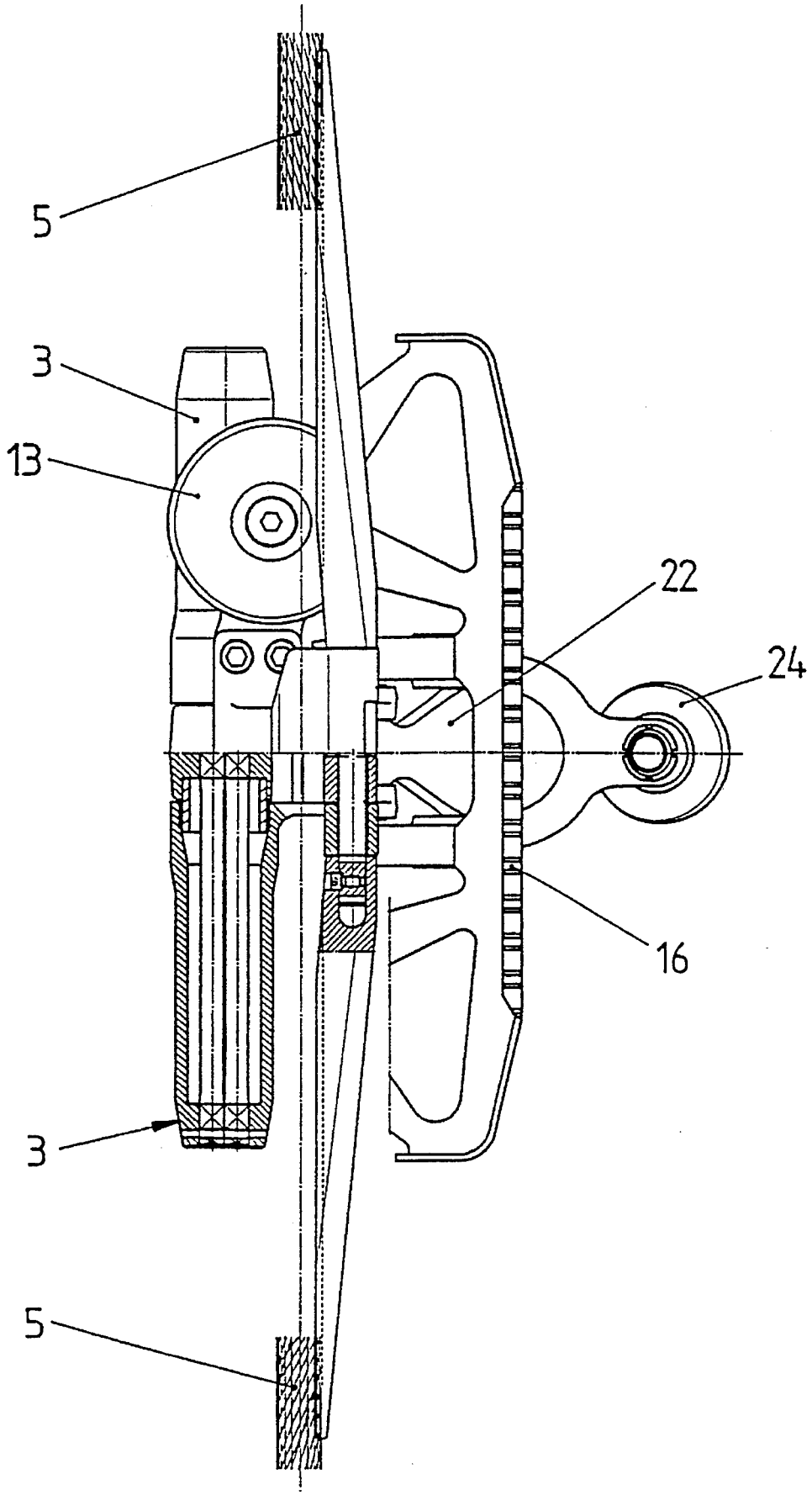
FIG. 4 is a partly sectional view of the device as seen in the direction of the arrow C in FIG. 1.

It can be seen from FIGS. 3 and 4 that the clamping lever 23 and the pivotable clamping jaw 25 are each embodied in forked fashion, and that the clamping body 1 is embodied with a pair of running wheels 13.

Figure 5:
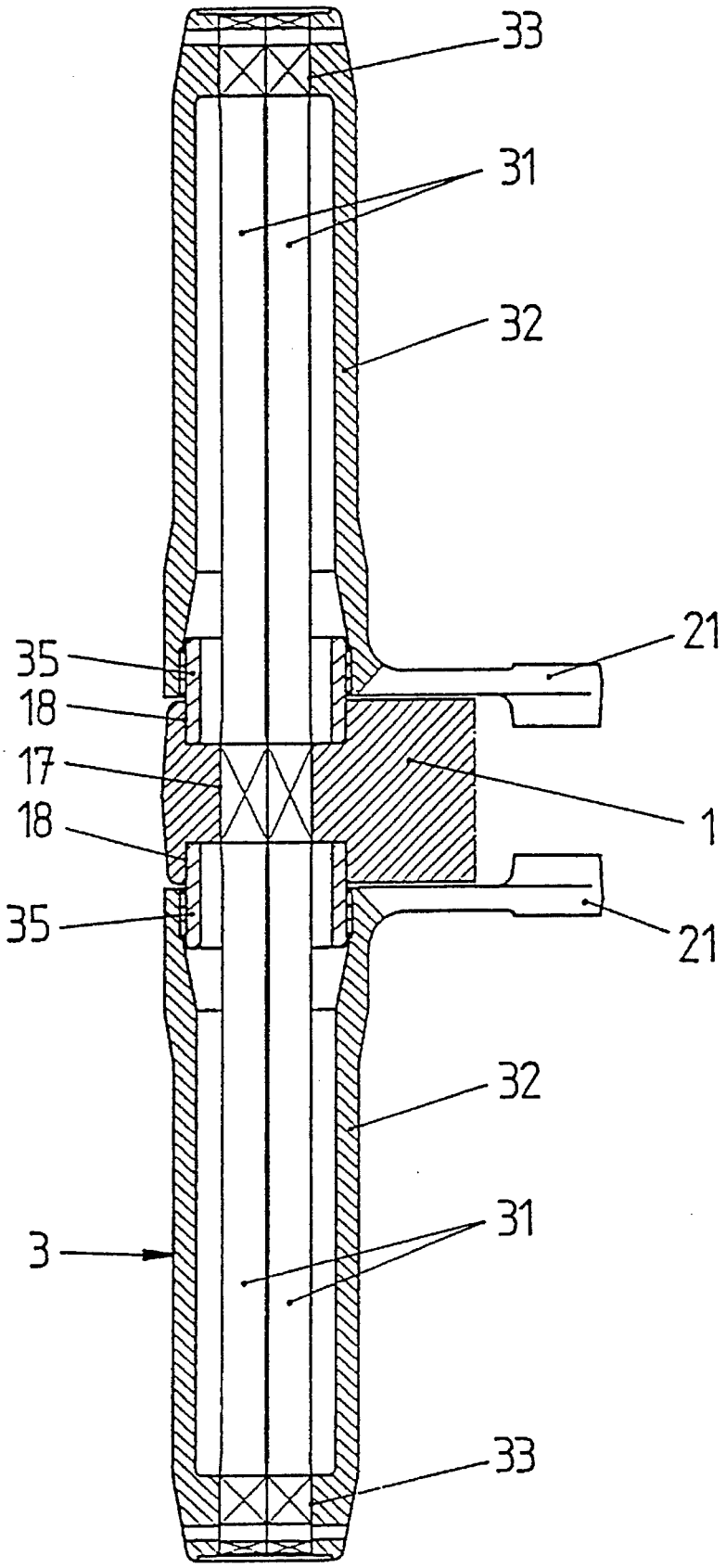
FIG. 5 is an axial sectional view of a component of the device.

FIG. 5 shows the embodiment of the torsion spring 3 and its connection to the clamping body 1 and to the first lever 21 of the toggle joint. As can be seen from this, the clamping body 1 has an opening 17 formed therein, in which four torsion rods 31, projecting to both sides of the clamping body 1, are secured. The two free ends of the torsion rods 31 pass through an opening 33, provided on the ends of each of two sleeves 32, and as a result these sleeves 32 are coupled for rotation with the free ends of the torsion rods 31. The ends of the sleeves 32 toward the clamping body 1 are supported on bushes 35 that are inserted into bores 18 of the clamping body 1. The two arms of the first lever 21 of the toggle joint adjoin the inner ends of the sleeves 32.

From torsion of the torsion rods 31, the requisite clamping force is generated in the closed position of the clamping jaw 25. Also, the clamp is held open after the toggle joint traverses its dead-center point.

The mutual disposition of the two levers 21 and 22 of the toggle joint and of the clamping lever 23 assures that the clamping force brought to bear by the torsion spring 3 in the closed position of the clamping jaw 25 is virtually independent of its position relative to the fixed clamping jaw 15. As a result, even if the diameter of the cable 5 decreases, the clamping force remains virtually constant. As a result, if the diameter of the cable 5 decreases from wear or from stretching of the cable, a reduction in the clamping force is averted that would cause the clamping device no longer to meet the technical requirements.

Figure 6:
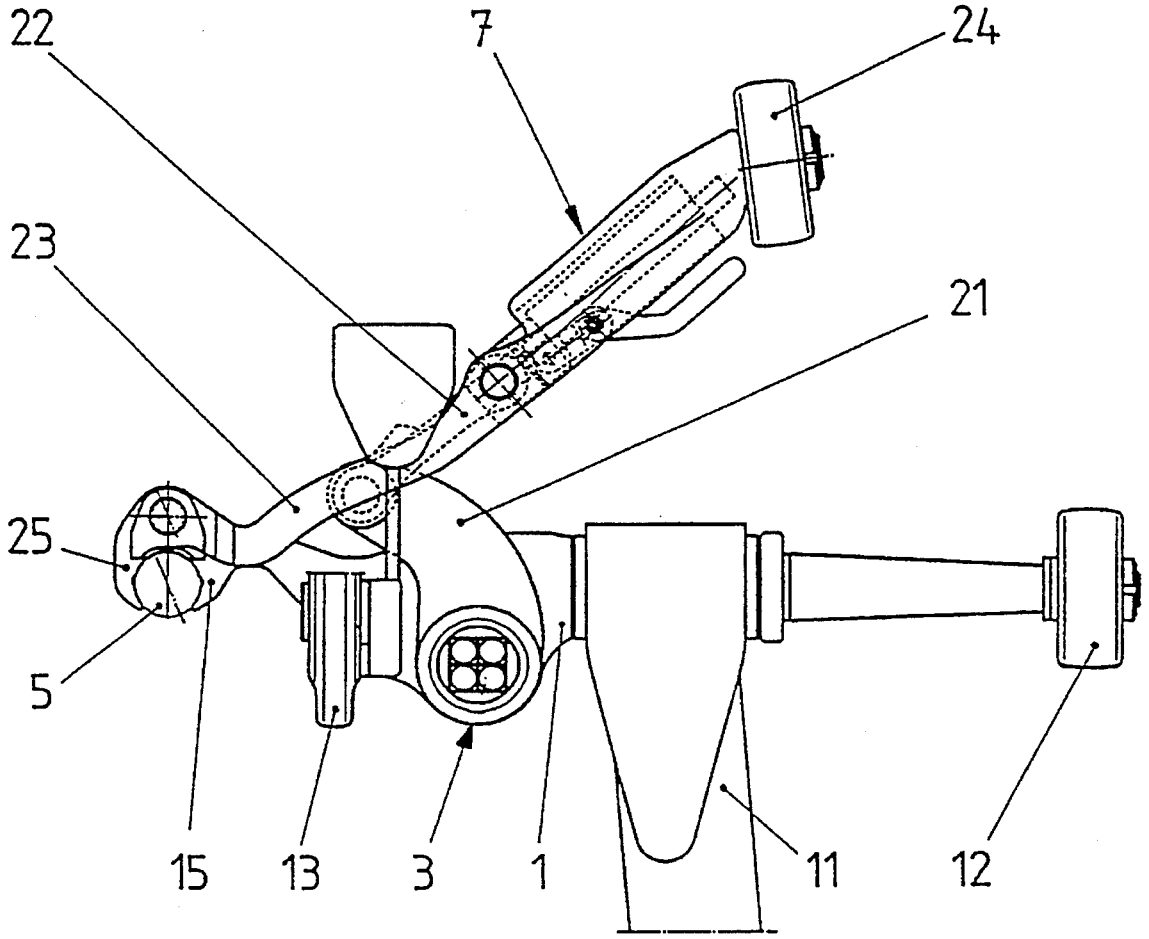
FIG. 6 is a side-elevational view of a second embodiment of the device in a closed position of the two clamping jaws.
Figure 7:
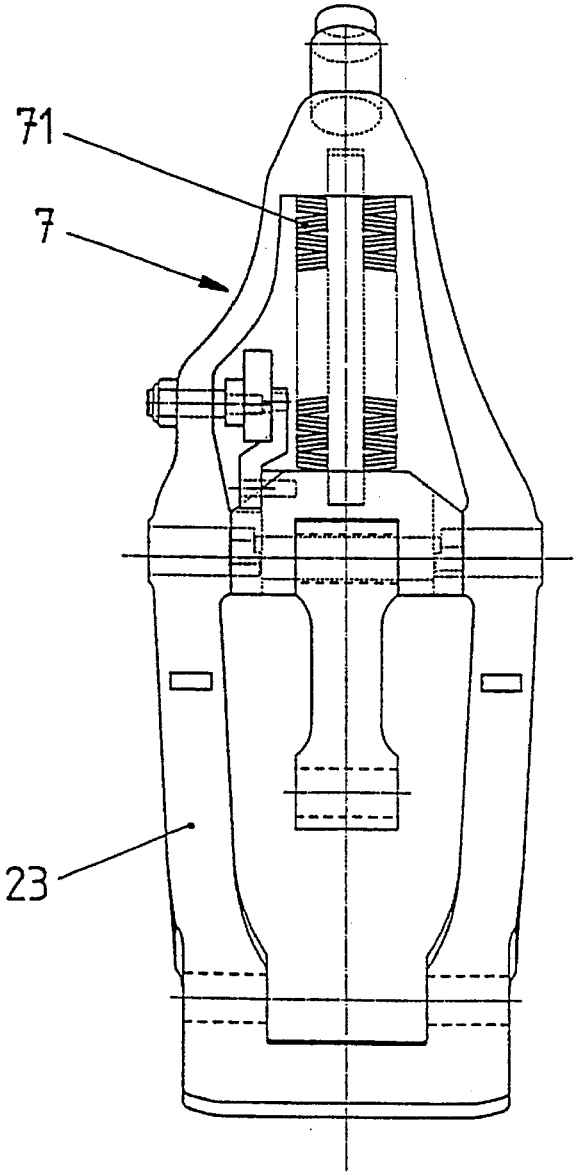
FIG. 7 is a plan view of a component of the clamping device according to FIG. 6.
Figure 8:
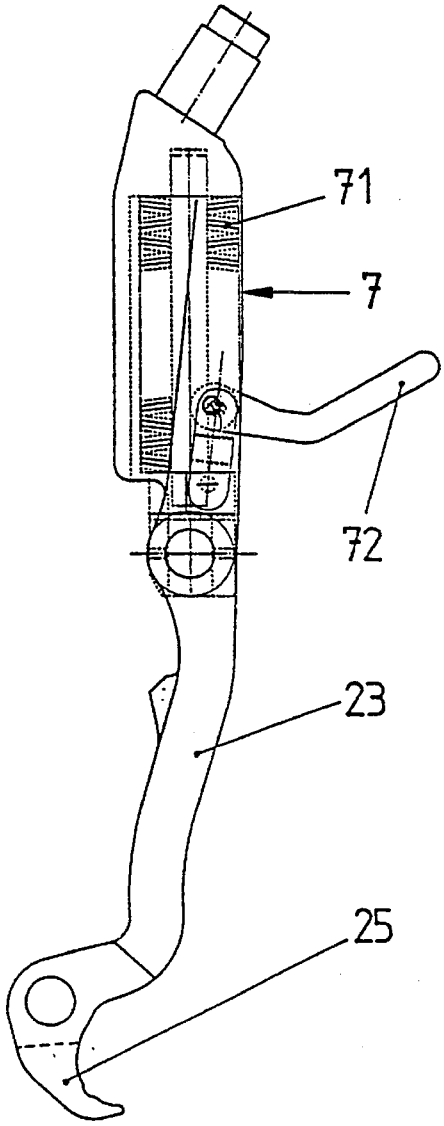
FIG. 8 is a side-elevational view of the component illustrated in FIG. 7.

The embodiment of the clamping device according to FIG. 6 is provided with a device 7 for testing the clamping force. With reference to FIGS. 7 and 8, the clamping lever 23 is provided with a test spring 71 that acts counter to the torsion spring 3. As soon as the compressive force of the torsion spring 3 drops below a predetermined value, the test spring 71 comes into action, causing a control lever 72 to pivot outwardly. Switches that are associated with the outward-pivoted test lever 72 are provided in the stations. As soon as the outward-pivoted test lever 72 meets one of the switches, the cableway system is turned off, whereupon the corresponding torsion spring can be inspected or replaced with a new, fully functional torsion spring.

I claim:

1. A device for coupling a ferrying means to the hoisting or load cable of a cableway system, comprising:

a clamping body having a first clamping jaw rigidly secured thereto;

a two-armed clamping lever pivotally supported on said clamping body, said clamping lever carrying a second clamping jaw on one end thereof which is pivotable relative to said first clamping jaw between an open and a closed position of the coupling device;

a torsion spring operatively associated with said clamping lever for biasing said clamping lever in the closed position of the coupling device; and a toggle joint disposed between and connecting said clamping lever and said torsion spring.

2. The device according to claim 1, including a cam roller carried on another end of said clamping lever, said cam roller to be received in cam rails for automatically actuating said clamping lever.

3. The device according to claim 1, wherein said toggle joint includes a first lever secured to a free end of said torsion spring, and a second lever supported on said clamping lever, and toggle pivot means for pivotally connecting said first and second levers.

4. The device according to claim 3, wherein said first and second levers of said toggle joint are pivotable into a beyond-dead-center position.

5. The device according to claim 3, including a first pivot bearing pivotally connecting said clamping lever with said second lever of said toggle joint, and a second pivot bearing pivotally supporting said clamping lever on said clamping body, and wherein said toggle pivot means is disposed between said first and second pivot bearings and, in a closed position of said clamping jaw, said toggle pivot means is located between said torsion spring and an imaginary line connecting Said first and second pivot bearings, while, in an open position of said clamping jaw, the imaginary line is located between said torsion spring and said toggle pivot means.

6. The device according to claim 5, wherein said toggle pivot means are located approximately centrally between said first and second pivot bearings.

7. The device according to claim 3, wherein said torsion spring includes a torsion rod having free ends projecting to both sides from said clamping body, sleeves secured on respective ones of said free ends of said torsion rod, and wherein said first lever Of said toggle joint is formed of two lever arms respectively secured to respective ones of said sleeves.

8. The device according to claim 7, including a bush supported on said clamping body, and wherein said sleeves, on one end thereof, are rigidly joined to respective ones of said free ends of said torsion rod, and, on another end thereof at which said first levers of said toggle joint are attached, are supported on said bush.

9. The device according to claim 1, including a clamping force testing device operatively associated with said clamping lever.

* * * * *